United States Patent [19]

Rowley

[11] Patent Number: 5,054,407

[45] Date of Patent: Oct. 8, 1991

[54] PRESSER FOOT HAVING AN ADJUSTABLE GUIDE FOR SEQUIN AND RIBBON

[76] Inventor: Clare J. Rowley, 13134 Silver Creek St., Moorpark, Calif. 93021

[21] Appl. No.: 575,172

[22] Filed: Aug. 30, 1990

Related U.S. Application Data

[63] Continuation-in-part of Ser. No. 495,999, Mar. 20, 1990.

[51] Int. Cl.[5] ..... D05B 29/00; D05B 29/08; D05B 29/12

[52] U.S. Cl. ..... 112/235; 112/152; 112/156

[58] Field of Search ..... 112/60, 80.31, 80.32, 112/106, 136, 121.23, 148, 152, 153, 306, 308, 314, 320, 324, 235, 240, 265, 413

[56] References Cited

U.S. PATENT DOCUMENTS

| | | | |
|---|---|---|---|
| 836,198 | 11/1906 | Moffatt | 112/152 |
| 1,827,596 | 10/1931 | Maier | 112/152 |
| 1,899,399 | 2/1933 | Sanborn | 112/152 |
| 1,923,556 | 8/1933 | Sanborn | 112/152 |
| 2,125,459 | 8/1938 | Pitts et al. | 112/152 X |
| 2,241,264 | 5/1941 | Kucera | 112/152 X |
| 2,546,172 | 3/1951 | Smith | 112/152 X |
| 2,607,309 | 8/1952 | Soldo | 112/152 |
| 2,653,559 | 9/1953 | Picucci | 112/152 |
| 2,706,456 | 4/1955 | Stangler | 112/152 |
| 2,915,996 | 12/1959 | Charest | 112/152 X |
| 4,269,128 | 5/1981 | Boser et al. | 112/235 |

FOREIGN PATENT DOCUMENTS

| | | | |
|---|---|---|---|
| 2002997 | 1/1987 | Japan | 112/235 |
| 0985175 | 12/1982 | U.S.S.R. | 112/235 |

*Primary Examiner*—Werner H. Schroeder
*Assistant Examiner*—Ismael Izaguirre
*Attorney, Agent, or Firm*—Kelly, Bauersfeld & Lowry

[57] ABSTRACT

A presser foot for use in sewing an elongate ribbon-like material to a fabric sheet includes a sole and an adjustable ribbon/sequin guide assembly through which the ribbon-like material slidably passes. The ribbon/sequin guide assembly includes a tubular guide portion which slidably envelopes a portion of the ribbon-like material, and defines, in connection with the sole, a needle dropping gap through which the needle of a sewing machine penetrates the fabric to sew the ribbon-like material thereto. The ribbon/sequin guide assembly is laterally movable, as a unit, by the positioning of a nut on a threaded shank which is fixed relative to the sole. Extending upwardly from the tubular guide portion of the ribbon/sequin guide assembly is a U-shaped yoke which is slidably received onto the threaded shank. A nut, which is threaded onto the shank, is positioned within the yoke to move the ribbon/sequin guide assembly laterally as the nut is rotated about the shank. A stop guide pin fixed to the sole and extending parallel to the shank engages a portion of the ribbon/sequin guide assembly to prevent rotation of the guide assembly relative to the sole.

16 Claims, 2 Drawing Sheets

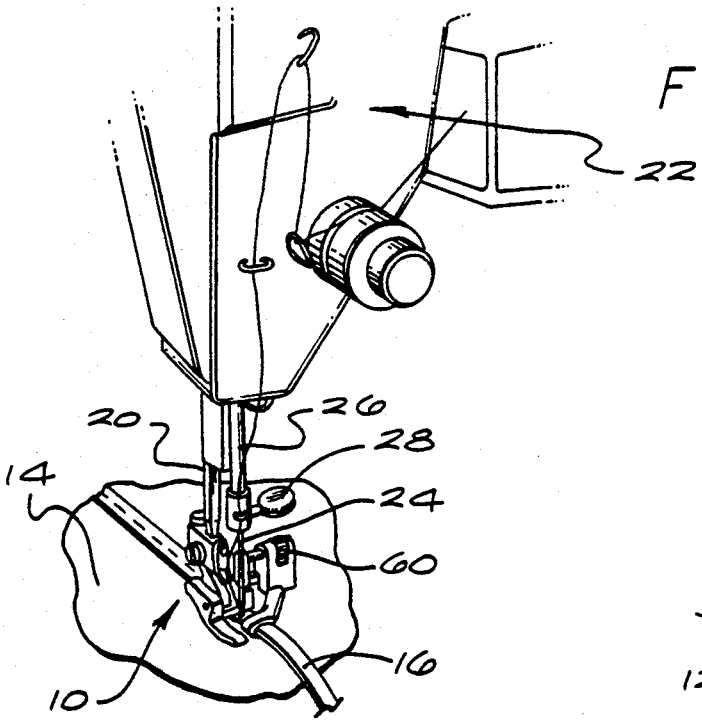
FIG. 1
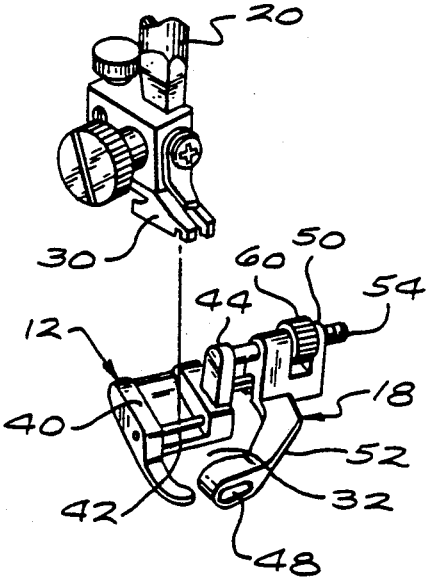
FIG. 2
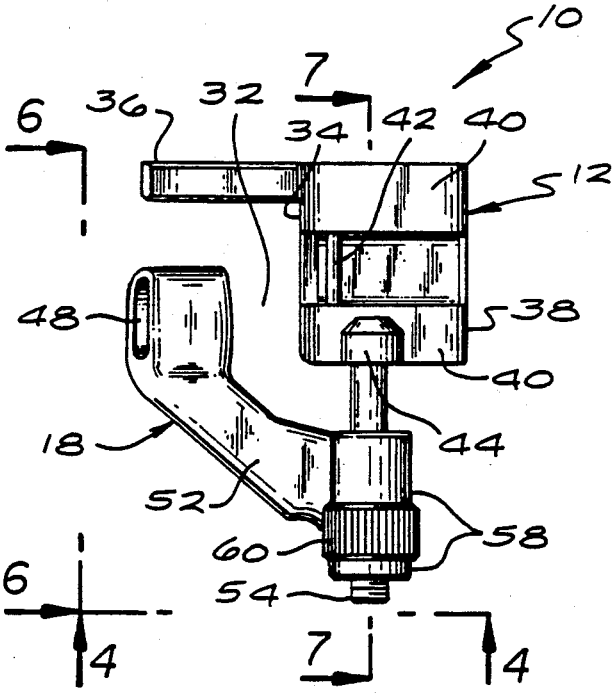
FIG. 3
FIG. 4
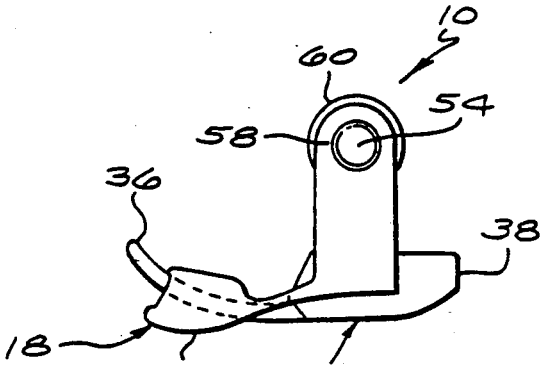

PRESSER FOOT HAVING AN ADJUSTABLE GUIDE FOR SEQUIN AND RIBBON

RELATED APPLICATION

This is a continuation-in-part of U.S. Pat. application Ser. No. 07/495,999 filed Mar. 20, 1990 and entitled SATIN STITCH PRESSER FOOT.

BACKGROUND OF THE INVENTION

This invention relates generally to sewing machines. More particularly, the present invention relates to an adjustable presser foot used in combination with a sewing machine to stitch a ribbon-like material to a fabric sheet.

It is often desirable to sew a ribbon-like material to a fabric sheet to give a garment a desired visual appearance. Such material may comprise ¼" ribbon, feathered edge ribbon, Ric-Rac, elastic banding or sequins. Such diverse materials, however, require different sewing techniques including alternate stitch patterns.

For example, ribbon and Ric-Rac is often sewn to an underlying fabric sheet utilizing a straight stitch pattern, while sequins are often attached utilizing a zig-zag stitch, although a straight stitch pattern is used in some applications. Elastic often requires a tricot or zig-zag stitch pattern. Presser foot pressure, thread tension, needle position and stitch length all vary, depending on the type of material being sewn.

One of the most important considerations i attaching a ribbon-like material to an underlying fabric sheet is that control must be maintained over the orientation of the ribbon-like material relative to the fabric feeding direction of the fabric sheet. Although several types of presser feet may be utilized during the sewing operation to help maintain this orientation, none of the prior presser foot designs provides a desired high degree of ribbon-orientation control. Another drawback of prior presser feet is the lack of adjustability to accommodate various types of materials and sewing conditions.

Accordingly, there has been a need for a novel adjustable presser foot for sequins and ribbon which can be used in connection with virtually all types of zig-zag sewing machines, and which is capable of efficiently accommodating most types of elongate ribbon-like material. Such a presser foot should permit use of a wide variety of thread types, tensions, stitch patterns and needle positions, and require little skill to use. Moreover, a novel presser foot is needed which may be adjusted as required by the stitching operation to be performed. The present invention fulfills these needs and provides other related advantages.

SUMMARY OF THE INVENTION

The present invention resides in an improved adjustable presser foot mounted to a sewing machine having a needle which is vertically reciprocated. The presser foot is detachably mounted to a lower end of a presser bar of the sewing machine and includes a sole to be pressed against a fabric sheet. Means associated with the sole are provided for guiding a ribbon-like material into a selected position and orientation relative to a leading edge of the sole. Means are further provided for adjustably positioning the ribbon guiding means laterally with respect to a fabric feeding direction.

In a preferred form of the invention the sole includes a lower generally planar surface and an upper portion which is attached to the presser bar. A ski extends outwardly from the leading edge of the sole in the fabric feeding direction.

The ribbon-like material guiding means comprises a ribbon guide assembly supported by the sole for slidably engaging the ribbon-like material. The ribbon guide assembly defines, in connection with the leading edge and the ski of the sole, a needle dropping gap through which the needle penetrates the fabric to sew the ribbon-like material thereto. The ribbon guide assembly includes a tubular portion at one end through which the ribbon-like material slidably passes, and an upwardly extending U-shaped yoke at the other end. The ribbon guide assembly serves to orient the ribbon-like material within the needle dropping gap such that the material's longitudinal axis lies substantially parallel to the fabric feeding direction.

The positioning means includes a threaded shank fixed with respect to the sole, which shank extends through aligned apertures in the U-shaped yoke of the ribbon guide assembly. A nut is positioned within the yoke and is threaded onto the shank such that movement of the nut along the threaded shank causes a corresponding lateral movement of the ribbon guide assembly relative to the sole.

The positioning means further includes means for preventing pivotal movement of the ribbon guide assembly relative to the threaded shank. This preventing means includes a stop guide pin fixed relative to the sole. The stop guide pin is spaced from and extends parallel to the threaded shank, and engages a portion of the ribbon guide assembly below the yoke. The stop guide pin further includes means for preventing disassociation of the ribbon guide assembly from the sole.

The adjustable presser foot of the present invention requires little skill to use and accommodates a wide variety of ribbon-like materials, including sequins, Ric-Rac and elastic.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is an environmental perspective view of an adjustable presser foot for sequins and ribbon embodying the invention as utilized in connection with a sewing machine having a needle which is vertically reciprocating and also laterally swingable;

FIG. 2 is an enlarged perspective view of the adjustable presser foot illustrated in FIG. 1, showing the manner in which the presser foot can be snap-fit onto the presser bar of the sewing machine;

FIG. 3 is an enlarged top plan view of the adjustable presser foot illustrated in FIGS. 1 and 2;

FIG. 4 is an elevational view of the presser foot taken generally in the direction of arrows 4—4 of FIG. 3;

DETAILED DESCRIPTION OF THE PREFERRED EMBODIMENT

Figure 5:
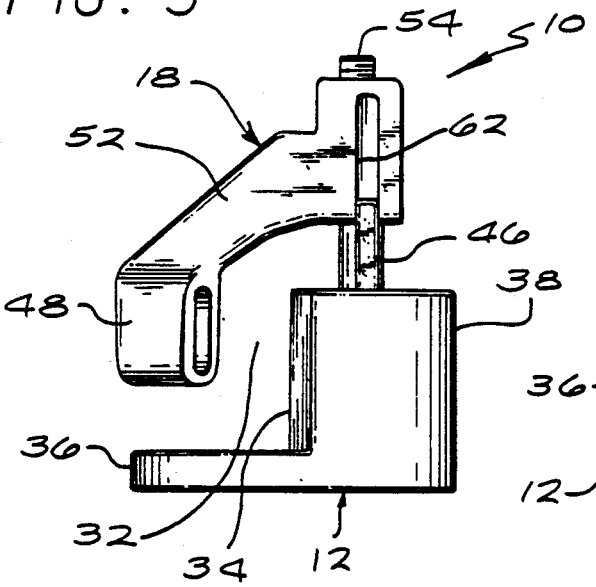
FIG. 5 is a bottom plan view of the adjustable presser foot embodying the invention.
Figure 6:
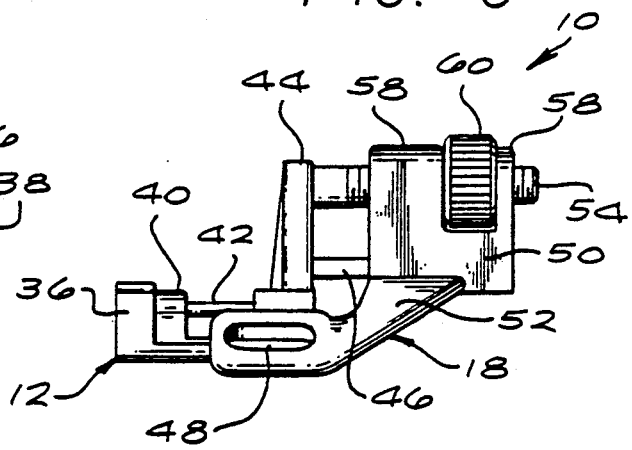
FIG. 6 is a front elevational view of the presser foot taken generally in the direction of arrows 6—6 of FIG. 3.

As shown in the drawings for purposes of illustration, the present invention is concerned with an improved adjustable presser foot, generally designated in the accompanying drawings by the reference number 10. The improved presser foot 10 comprises, generally, a sole 12 which is pressed against a fabric sheet 14 to which a ribbon-like material 16 is to be sewn, and a ribbon guide assembly 18 associated with the sole 12. The ribbon-like material 16 (which may comprise such various materials as Ric-Rac, elastic, ribbon and sequins) slidably passes through the ribbon guide assembly 18 to assure proper orientation thereof relative to the fabric sheet and the fabric feeding direction.

As illustrated in a working environment in FIGS. 1 and 2, the adjustable presser foot 10 is detachably mounted to the lower end of a presser bar 20 of a sewing machine 22. A needle 24 is attached to a needle bar 26 by means of a needle screw 28. In a zig-zag sewing machine 22, the needle 24 is vertically reciprocated and swingable laterally of the fabric feeding direction. The presser foot 10 is snap-fit onto a presser foot shank 30 situated at the lowermost end of the presser bar 20.

In accordance with the present invention, and as illustrated with respect to a preferred embodiment in FIGS. 2 through 7, the adjustable presser foot 10 comprises the aforementioned sole 12 which defines, in part, a laterally elongated needle dropping gap 32. The needle dropping gap 32 is defined, generally, as the space between the ribbon guide assembly 18 and a leading edge 34 of the sole 12, taken from a top plan view of the presser foot 10. The needle 24 penetrates the fabric sheet 14 and the ribbon-like material 16 during the sewing operation through the needle dropping gap 32. A ski 36 extends perpendicularly from the leading edge 34 of the sole 12 along the axis of the fabric feeding direction to define a lateral limit of the gap 32. The sole 12 further includes a heel portion 38 opposite to the leading edge 34, from under which pass the sewn-together ribbon-like material and fabric sheet.

An upper portion of the sole 12 includes a pair of laterally spaced apart abutments 40 which are formed adjacent to the leading edge 34 and the needle dropping gap 32. A pin 42 laterally extends between the abutments 40, by which the presser foot 10 may be detachably mounted to the presser foot shank 30. Extending upwardly from one of the abutments 40 is a support 44 for the ribbon guide assembly 18. Extending laterally outwardly from the support 44 is a stop guide arm 46 which cooperates with a portion of the ribbon guide assembly 18 to prevent undesirable rotation thereof.

The ribbon guide assembly 18 is adjustably attached to the sole 12 and is provided means for moving the assembly 18 laterally with respect to the sole. The ribbon guide assembly 18 includes a tubular ribbon/sequin guide 48 which is adjustably positionable and through which the ribbon-like material 16 slidably passes, an upwardly extending U-shaped yoke 50, and an intermediate portion 52 formed integrally with the tubular guide 48 and the yoke 50.

Means are provided for adjustably positioning the ribbon guide assembly 18 with respect to the sole 12. In particular, a threaded shank 54 is fixed within the upper end of the support 44 and extends laterally outwardly therefrom. The shank 54 is slidably positioned within apertures 56 provided through the upwardly extending members 58 of the U-shaped yoke 50. A nut 60 is threaded onto the shank 54 and positioned between these upwardly extending members 58. This arrangement causes the yoke 50, and consequently the entire ribbon guide assembly 18, to move laterally along the shank 54 as the nut 60 is turned.

Figure 7:
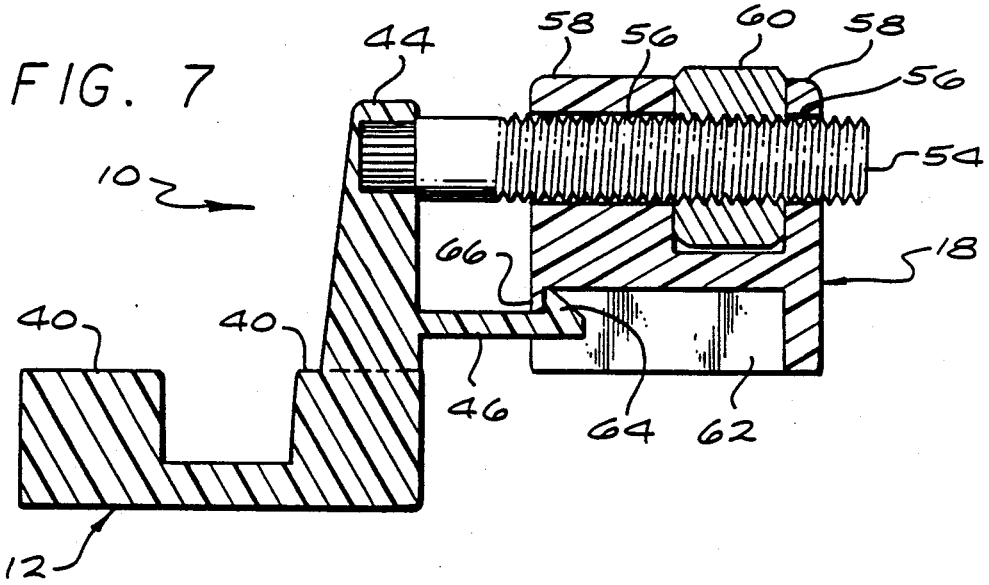
FIG. 7 is an enlarged, partially sectional view taken generally along the line 7—7 of FIG. 3.

Situated directly below the aligned apertures 56 and the shank 54, the ribbon guide assembly 18 includes a receiving groove 62 for the stop guide arm 46. The interaction of the stop guide arm 46 within the receiving groove 62 acts as a means for preventing pivotal movement of the ribbon guide assembly 18 relative to the threaded shank 54. As illustrated in FIG. 7, the stop guide pin 46 includes a latch tooth 64 at one end. The latch tooth 64 configured to catch on a flange 66 provided at the inner end of the receiving groove 62 to prevent disassociation of the ribbon guide assembly 18 from the sole 12.

Although not illustrated, a small or shallow channel may be formed beneath the sole 12 in order to accommodate the ribbon-like material 16 as it passes under the sole 12.

To use the adjustable presser foot 10 of the present invention, the pin 42 is snap-fit into the receiving grooves provided on the presser foot shank 30 (FIG. 2). An appropriate needle should be selected to obtain the desired stitching effect. As mentioned previously, the presser foot 10 may be utilized with zig-zag stitches as well as straight stitches.

Figure 8:
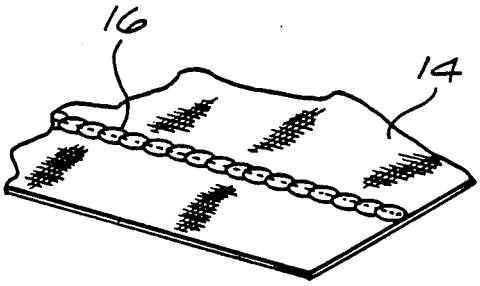
FIG. 8 is a fragmented perspective view of a fabric sheet having a string of sequins sewn thereon utilizing the adjustable presser foot of the present invention.

When sewing a ribbon or elastic (FIG. 1) or a string of sequins (FIG. 8) to an underlying fabric sheet 14, the ribbon-like material 16 is inserted through the tubular ribbon/sequin guide 48 of the ribbon guide assembly 18 and under the sole 12. The ribbon guide assembly 18 may be adjusted by simply turning the nut 60 to position the ribbon-like material 16 where desired within the needle dropping gap 32. The cooperation of the nut 60 with the threaded shank 54 permits the ribbon guide assembly 18 to be located in the most desirable position.

From the foregoing it is to be appreciated that the improved adjustable presser foot 10 is capable of accommodating many different types of ribbon-like material 16 sewn onto an underlying fabric sheet 14. The presser foot 10 maintains control over the orientation of the ribbon-like material relative to the fabric feeding direction, and requires little skill to use.

Although a particular embodiment of the invention has been described in detail for purposes of illustration, various modifications may be made without departing from the spirit and scope of the invention. Accordingly, the invention is not to be limited, except as by the appended claims.

I claim:

1. An adjustable presser foot mounted to a sewing machine having a vertically reciprocated needle, the presser foot comprising:

a sole being pressed against a fabric to be sewn, having a leading edge extending generally laterally to a fabric feeding direction;

means attached to the sole for guiding a ribbon-like material into a selected position and orientation relative to the leading edge of the sole, wherein the guiding means and the leading edge of the sole define a needle dropping gap through which the needle penetrates a fabric to sew the ribbon-like material thereto; and means for adjustably positioning the guiding means laterally with respect to the fabric feeding direction.

2. A presser foot as set forth in claim 1, wherein the guiding means slidably engages the ribbon-like material to position a portion of the ribbon-like material within the gap such that a longitudinal axis of the ribbon-like material lies substantially parallel to the fabric feeding direction.

3. A presser foot as set forth in claim 1, wherein the guiding means includes a tubular guide which slidably engages the ribbon-like material.

4. A presser foot as set forth in claim 1, wherein the guide means includes means for attaching said guiding to the sole to allow lateral movement of the guiding means while preventing rotation movement thereof with respect to the sole.

5. A presser foot as set forth in claim 1, wherein the positioning means includes a threaded shank fixed with respect to the sole, a nut threaded onto the shank, and means cooperating with the nut for moving the guiding means in accordance with lateral movement of the nut on the threaded shank.

6. A presser foot as set forth in claim 5, wherein the means cooperating with the nut for moving the guiding means includes a U-shaped yoke formed with the guiding means, for receiving the nut therein, wherein the yoke includes aligned apertures, and wherein the shank slidably passes through the aligned apertures.

7. A presser foot as set forth in claim 5, wherein the positioning means includes means for preventing pivotal movement, relative to the threaded shank, of the means cooperating with the nut for moving the guiding means.

8. A presser foot as set forth in claim 7, wherein the preventing means includes a stop guide pin spaced from and extending parallel to the threaded shank, for engaging the guiding means.

9. A presser foot as set forth in claim 8, wherein the stop guide pin includes means for preventing disassociation of the guiding means from the sole.

10. An adjustable presser foot detachably mounted to the lower end of a presser bar of a sewing machine having a vertically reciprocated needle, the presser foot comprising:

a sole mounted to the lower end of the presser bar the sole being pressed against a fabric to be sewn and having a leading edge extending generally laterally to a fabric feeding direction;

a ribbon guide assembly supported by the sole for slidably engaging a ribbon-like material, wherein the ribbon guide assembly and the leading edge of the sole define a needle dropping gap through which the needle penetrates the fabric to sew the ribbon-like material thereto, the ribbon guide assembly orienting the ribbon-like material within the gap so as to position a portion of the ribbon-like material therein such that a longitudinal axis of the ribbon-like material lies substantially parallel to the fabric feeding direction; and means for adjustably positioning the ribbon guide assembly laterally with respect to the fabric feeding direction.

11. A presser foot as set forth in claim 10, wherein the sole includes a ski defining a lateral limit of the needle dropping gap, a lower generally planar surface for engaging the fabric to be sewn, and an upper portion for supporting the ribbon guide assembly.

12. A presser foot as set forth in claim 10, wherein the ribbon guide assembly includes a tubular ribbon/sequin guide for enveloping a portion of the ribbon-like material.

13. A presser foot as set forth in claim 10, wherein the ribbon guide assembly includes a U-shaped yoke, and wherein the positioning means includes a threaded shank fixed with respect to the sole and slidably extending through aligned apertures provided through the U-shaped yoke, and a nut threaded onto the shank and positioned within the U-shaped yoke such that rotating the nut about the shank displaces the ribbon guide assembly laterally with respect to the sole.

14. A presser foot as set forth in claim 13, wherein the positioning means includes means for preventing pivotal movement of the ribbon guide assembly relative to the threaded shank, the preventing means including a stop guide pin fixed relative to the sole and extending parallel to the threaded shank and slidably engaging the ribbon guide assembly.

15. A presser foot as set forth in claim 14, wherein the stop guide pin includes means for preventing disassociation of the ribbon guide assembly from the sole.

16. An adjustable presser foot detachably mounted to a lower end of a presser bar of a sewing machine having a needle vertically reciprocated and swingable laterally of a fabric feeding direction, the presser foot comprising:

a sole mounted to the lower end of the presser bar, the sole being pressed against a fabric to be sewn and including a leading edge extending generally laterally to the fabric feeding direction, a ski projecting forwardly of the leading edge and generally parallel to the fabric feeding direction, a lower generally planar surface, and an upper portion attached to the presser bar;

a ribbon guide assembly supported by the upper portion of the sole for slidably engaging a ribbon-like material, the ribbon guide assembly including a tubular ribbon/sequin guide for slidably enveloping a portion of the ribbon-like material, wherein the ribbon guide assembly, the ski and the leading edge of the sole define a needle dropping gap through which the needle penetrates the fabric to sew the ribbon-like material thereto, and wherein the ribbon guide assembly orients the ribbon-like material within the gap such that a longitudinal axis of the ribbon-like material lies substantially parallel to the fabric feeding direction, the ribbon guide assembly including a U-shaped yoke;

means for adjusting positioning the ribbon guide assembly laterally with respect to the fabric feeding direction, the positioning means including a threaded shank fixed with respect to the sole and slidably extending through the yoke, and a nut threaded onto the shank and positioned within the yoke; and means for preventing pivotally movement of the ribbon guide assembly relative to the threaded shank, the preventing means including a stop guide pin fixed relative to the sole and extending parallel to the threaded shank for engaging the ribbon guide assembly.

* * * * *

UNITED STATES PATENT AND TRADEMARK OFFICE

CERTIFICATE OF CORRECTION

PATENT NO. : 5,054,407

DATED : October 8, 1991

INVENTOR(S) : Clare J. Rowley

It is certified that error appears in the above-identified patent and that said Letters Patent is hereby corrected as shown below:

In column 1, line 30, delete "i" and insert therefor --in--.

In column 4, line 18, insert "is" between "64" and "configured".

In column 5, line 16, insert "means" after the word "guiding".

In column 6, line 54, delete "adjusting" and insert therefor --adjustably--.

In column 6, line 61, delete "pivotally" and insert therefor --pivotal--.

Signed and Sealed this

Nineteenth Day of January, 1993

*Attest:*

DOUGLAS B. COMER

*Attesting Officer*

*Acting Commissioner of Patents and Trademarks*